US009701450B1

(12) United States Patent
Elston

(10) Patent No.: US 9,701,450 B1
(45) Date of Patent: Jul. 11, 2017

(54) CONTAINER FOR STORING SMALL ITEMS AND RELATED METHODS

(71) Applicant: Stephen Elston, Ormond Beach, FL (US)

(72) Inventor: Stephen Elston, Ormond Beach, FL (US)

( * ) Notice: Subject to any disclaimer, the term of this patent is extended or adjusted under 35 U.S.C. 154(b) by 56 days.

(21) Appl. No.: 14/820,627

(22) Filed: Aug. 7, 2015

Related U.S. Application Data

(60) Provisional application No. 62/034,226, filed on Aug. 7, 2014.

(51) Int. Cl.

| | |
|---|---|
| ***B65D 43/16*** | (2006.01) |
| ***B65D 25/10*** | (2006.01) |
| ***B65D 25/22*** | (2006.01) |
| ***B65D 43/22*** | (2006.01) |
| ***B65D 51/18*** | (2006.01) |
| ***B65D 25/28*** | (2006.01) |
| ***B65D 25/20*** | (2006.01) |

(52) U.S. Cl.
CPC ..... *B65D 43/169* (2013.01); *B65D 25/10* (2013.01); *B65D 25/205* (2013.01); *B65D 25/22* (2013.01); *B65D 43/22* (2013.01); *B65D 51/18* (2013.01); *B65D 2101/0015* (2013.01); *B65D 2251/009* (2013.01); *B65D 2251/0018* (2013.01); *B65D 2251/0028* (2013.01); *B65D 2251/0084* (2013.01)

(58) Field of Classification Search
CPC .... B65D 43/169; B65D 51/18; B65D 25/205; B65D 25/22; B65D 43/22; B65D 25/10; B65D 2101/0015; B65D 2251/0018; B65D 2251/0028; B65D 2251/0084; B65D 2251/009
USPC ..... 220/500–557, 259.1, 735, 736
See application file for complete search history.

(56) References Cited

U.S. PATENT DOCUMENTS

| | | | | | |
|---|---|---|---|---|---|
| 3,612,335 | A * | 10/1971 | Schurman | B65D 11/00 | 190/119 |
| D293,583 | S * | 1/1988 | Dunlap | D15/7 | |
| 5,670,268 | A * | 9/1997 | Mancusi | H01M 2/1022 | 206/705 |
| 6,015,064 | A * | 1/2000 | Liu | A45C 13/02 | 206/372 |
| 6,105,767 | A * | 8/2000 | Vasudeva | B25H 3/023 | 206/349 |

* cited by examiner

*Primary Examiner* — Robert J Hicks
*Assistant Examiner* — Kareen Thomas
(74) *Attorney, Agent, or Firm* — Allen Dyer Doppelt & Gilchrist

(57) ABSTRACT

A container has a container base, a container lid and a closure. The container base includes a back member and a base sidewall extending upwardly therefrom. The container lid is hingedly-connected to the base and movable relative thereto between closed and open positions, the container lid including a front member and a lid sidewall extending downwardly therefrom. The closure extending from the container lid and engaging the container base to maintain the container lid in the closed position. A resilient insert with a plurality of storage receptacles for small items is accommodatable in the container base.

19 Claims, 3 Drawing Sheets

CONTAINER FOR STORING SMALL ITEMS AND RELATED METHODS

CROSS-REFERENCE TO RELATED APPLICATION

This application claims the benefit of U.S. Provisional Application Ser. No. 62/034,226, filed on Aug. 7, 2014, the contents of which are herein incorporated by reference in their entirety.

FIELD OF THE INVENTION

The present invention relates to containers, and more particularly, to containers for storing multiple small items.

BACKGROUND OF THE INVENTION

Small hazardous or fragile items, such as medicine, require carefully and thoughtfully designed containers due to possible excessive movements during transportation of the items. The items may be broken or damaged if they are not properly packaged. In some cases, the items must be sold together in the same container, thus it is more likely that the items may be shifted, damaged or broken, either in transit or while on display, if they are not properly secured inside the container. Although various containers have been used to store small hazardous or fragile items together, further improvements are possible.

SUMMARY OF THE INVENTION

In view of the foregoing, it is an object of the present invention to provide an improved container for storing small items and related methods of making and use. According to an embodiment of the present invention, a container has a container base, a container lid and a closure. The container base includes a back member and a base sidewall extending upwardly therefrom. The container lid is hingedly-connected to the base and movable relative thereto between closed and open positions, the container lid including a front member and a lid sidewall extending downwardly therefrom. The closure extending from the container lid and engaging the container base to maintain the container lid in the closed position. A resilient insert with a plurality of storage receptacles for small items is accommodatable in the container base.

According to an aspect of the invention, the container base and lid can each be formed as a unitary piece of stamped metal. A first closure member can be integrally formed with the container lid, with a hingedly-attached second closure member traversing a 90 degree angle to extend across portions of the base sidewall and back member. An adhesive label applied to the back member can cover a portion of the second closure member, and the closure can also be biased against the container base, to inhibit inadvertent release.

These and other objects, aspects and advantages of the present invention will be better understood in view of the drawing and following detailed description of preferred embodiments.

DETAILED DESCRIPTION OF PREFERRED EMBODIMENTS

Figure 1:
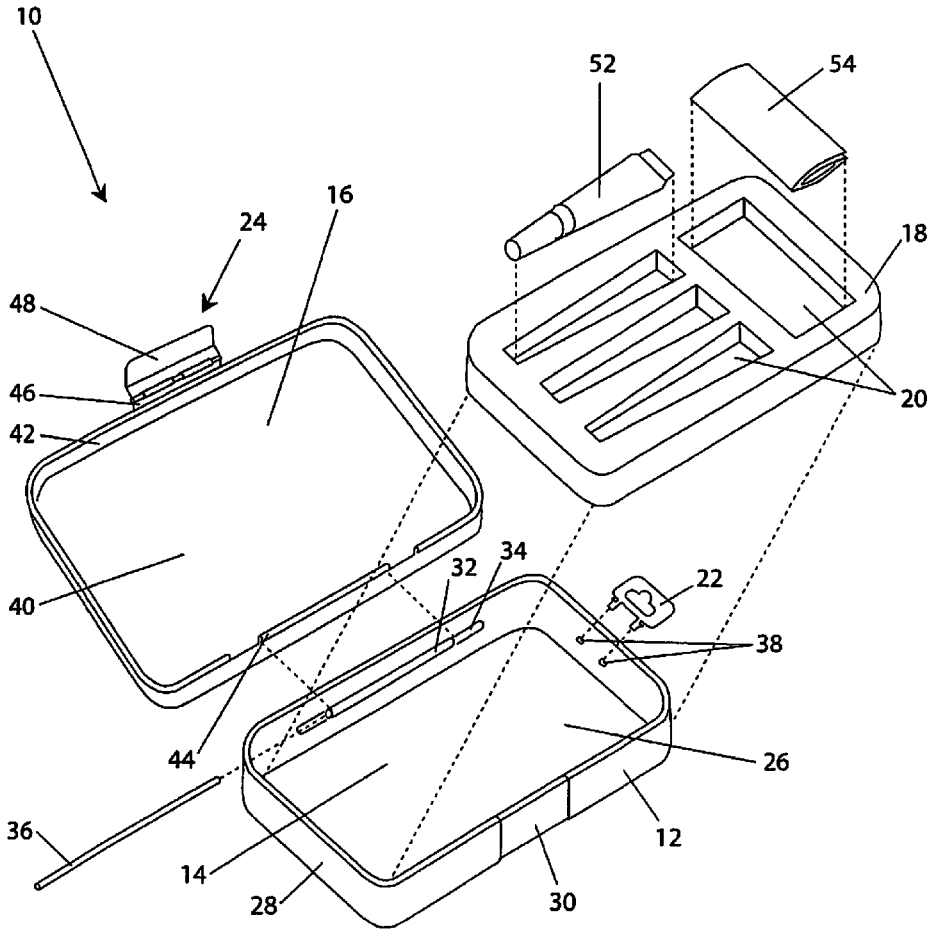
FIG. 1 is a partially-exploded perspective view of a container, according to an embodiment of the presented invention, in an open position.
Figure 2:
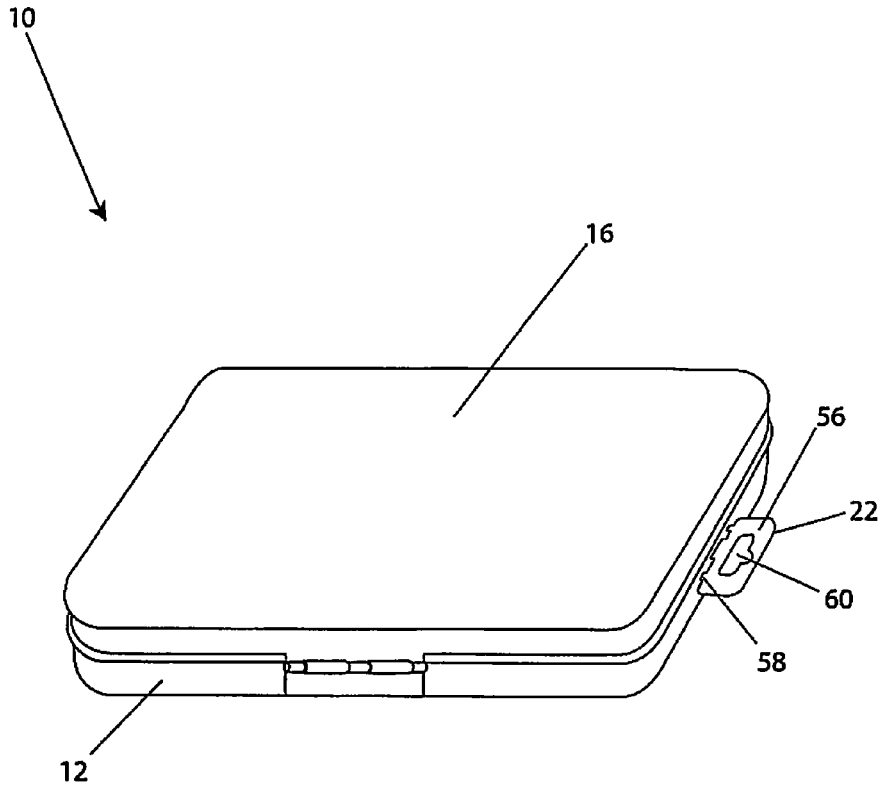
FIG. 2 is a top perspective view of the container of FIG. 1, in a closed position with a closure thereof secured.

According to an embodiment of the present invention, referring to FIGS. 1 and 2, a container 10 includes a container base 12 defining a container volume 14, and a lid 16 connected to the base 12 and repositionable relative thereto between open (FIG. 1) and closed (FIG. 2) positions so as to selectively cover and uncover the container volume 14. The container 10 further includes an insert 18 located in the base 12 and defining one or more storage receptacles 20, as well as a hanger 22 for retail display. Advantageously, the lid 16 is hingedly connected to the base 12 and maintained in the closed position by a closure 24.

Directional terms, such as top, bottom, left, right, front and back are referenced to an orientation in which the container 12 is suspended by the hanger 22 with the lid 16 facing forwards. However, the present invention is not thereby limited to use in any particular orientation.

Figure 3:
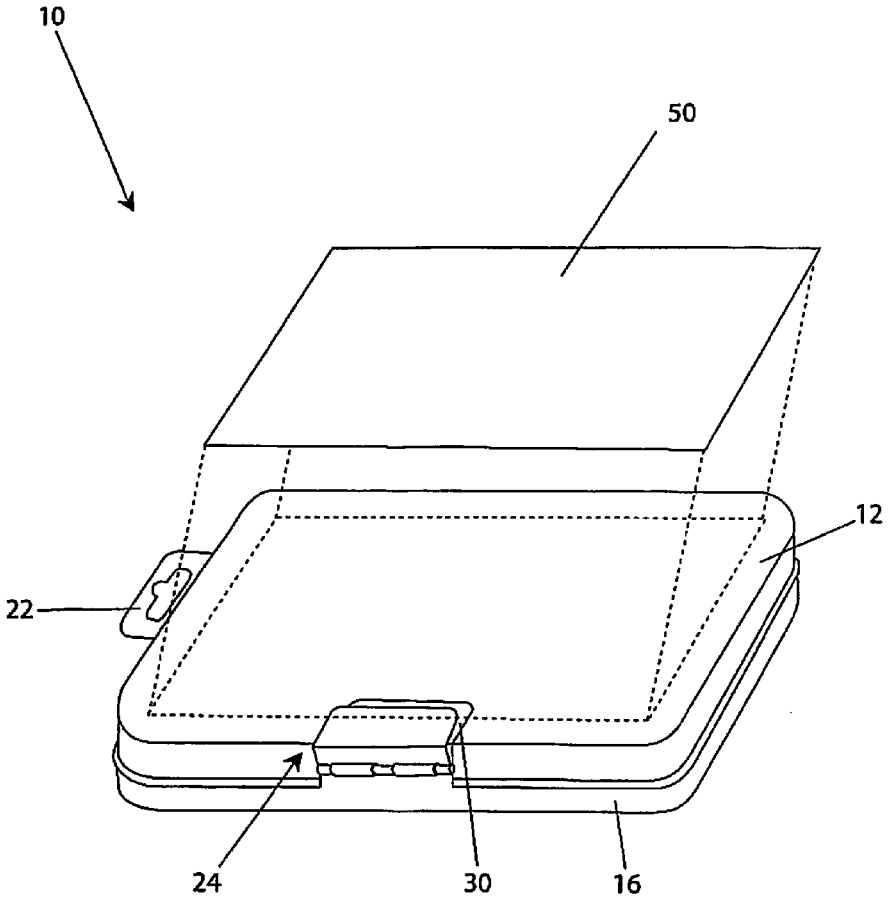
FIG. 3 is a bottom perspective view of the container of FIG. 1, in the closed position with the closure partially released.

The container base 12 includes a back member 26 that transitions into at least one base sidewall 28 extending upwardly therefrom, which cooperatively define the container volume 14. In the depicted embodiment, the base sidewall 28 includes top, bottom and opposite side sections connected by rounded transitions. Referring also to FIG. 3, a recessed area 30 is defined extending from a side section of the sidewall 28 to the back member 26 such that the closure 24 lies flush therewith when secured. An inwardly extending hinge channel section 32 and outwardly extending hinge channel sections 34 are formed in an opposite side section of the sidewall 28 to receive a hinge pin 36, for hinged connection with the lid 16. Additionally, the base 12 defines hanger mounting holes 38 on the top section of the sidewall 28 to receive the hanger 22.

The lid 16 includes a front member 40 that transitions into at least one lid sidewall 42 extending downwardly therefrom. In the depicted embodiment, the lid sidewall 42 includes top, bottom and opposite side sections connected by rounded transitions. The lid sidewall 42 is dimensioned to be slightly larger than the base sidewall 28, so that it lies closely adjacent to, and outside of, the base sidewall 28 when the lid 16 is closed. A hinge cylinder 44, open at opposite ends thereof, is formed on one of the side sections of the lid sidewall 42. To hingedly connect the lid 16 to the container base 12, the hinge cylinder 44 is seated in the inwardly extending hinge channel section 32 and the hinge pin 36 is inserted therethrough, with opposite ends of the pin being seated in the outwardly extending hinge channel sections 34.

The closure 24 includes first and second closure members 46, 48 that are hingedly-connected. The first closure member 46 is attached to, or more preferably, formed integrally with, the lid 26 and extends from a lower edge of one of the side sections of the lid sidewall 42. The second closure member 48 extends downwardly therefrom and traverses a 90 degree angle to as to be seated in the recessed area 30 when the closure 24 is secured. Advantageously, the second closure member 48 is biased relative to the first closure member 46 into the secured position; for instance, via a hinge-spring or other biasing mechanism. This biasing helps ensure that the lid 16 is maintained in the close position by the closure 24.

An adhesive label 50 could be applied to the base 12 such that a portion of the label 50 overlies the second closure member 48 in the recessed area 30. The label 50 could be pre-cut to avoid interference with operation of the closure 24, or left intact to further prevent unintentional opening of the container 10. In addition to the label 50, other pictures or text may be printed on, embossed in, or otherwise attached to interior or exterior surfaces of the container base 12 and lid 16.

The container base 12 and lid 16 are rectangular in form. The base 12 and lid 16 are made of one or more materials having suitable properties for a desired application, including strength, weight, rigidity, etc. Metals and plastics are generally preferred. In an advantageous embodiment, the base 12 and lid 16 are each formed as unitary pieces; for example by stamping from a single sheet of metal. Terminal edges of the lid 16 and base 12 can be rolled for reinforcement.

The insert 18 is dimensioned to be closely accommodated within the container volume 14. The storage receptacles 20 are defined as recesses on the insert 18, such that a portion of the insert 18 remains between the items stored therein and the back member 26 of the container base 12. Contours of the receptacles 20 are configured to closely accommodate the items to be stored therein. For instance, in the depicted embodiment three of the receptacles 20 are configured to accommodate small tubes 52, and another receptacle 20 is configured to accommodate folded instructions 54 relating to the use thereof. An example of a tube believed to be particularly advantageous for storage in the container 10 can be seen in present inventor's U.S. Non-Provisional patent application Ser. No. 14/171,928, filed on Feb. 5, 2013, the contents of which are hereby incorporated by reference in their entirety.

Advantageously, the insert 18 is made from a resilient material, such as foam rubber. The resiliency of the material helps secure the items with a slight interference fit, while allowing for easy removal. The installation and retention of the insert 18 within the container base 12 is likewise facilitated.

Referring more particularly to FIGS. 1 and 2, the hanger 22 consists of a head 56 and one or more legs 58. The head 56 portion of the hanger 22 defines a central opening 60 dimensioned for suspension on a hook or the like, such as a pegboard hook for retail display. The legs 58 are received in the hanger mounting holes 38. The tip of the leg 58 is slightly larger than the size of the hole 38 to prevent the hanger 22 from pulling out of the hanger mounting holes 38 after insertion. Preferably, the hanger 22 is made out of plastic, but it could be made out of any material having sufficient strength to hold up the weight of the container 10 and its contents.

In general, the foregoing description is provided for exemplary and illustrative purposes; the present invention is not necessarily limited thereto. Rather, those skilled in the art will appreciate that additional modifications, as well as adaptations for particular circumstances, will fall within the scope of the invention as herein shown and described and of the claims appended hereto.

What is claimed is:

1. A container comprising:

a container base including a back member and a base sidewall extending upwardly therefrom;

a container lid hingedly-connected to the container base and movable relative thereto between a closed position and an open position, the container lid including a front member and a lid sidewall extending downwardly therefrom;

a closure extending from the container lid and engaging the container base to maintain the container lid in the closed position; and a hanger having a head defining a central opening and at least one leg received in a hanger mounting hole of the container base.

2. The container of claim 1, wherein the container base and container lid are each formed as a unitary piece.

3. The container of claim 2, wherein the container base and container lid we each stamped metal.

4. The container of claim 1, wherein the lid sidewall at least partially covers the base sidewall in the closed position.

5. The container of claim 1, wherein the container base and container lid are hingedly-connected by a hinge pin inserted through a hinge cylinder aligned with hinge channel section.

6. The container of claim 5, wherein the hinge cylinder is on the lid sidewall and the hinge channel sections are on the base sidewall.

7. The container of claim 6, wherein the hinge cylinder and the hinge channel sections are formed as a single piece with the lid sidewall and base sidewall, respectively.

8. The container of claim 1, wherein the closure includes hingedly-connected first and second closure members, the first closure member being located on the lid and the second closure member releasably engaging the container base.

9. The container of claim 8, wherein the first closure member extends from a lower edge of the lid sidewall.

10. The container of claim 9, wherein the first closure member is formed integrally with the lid sidewall.

11. The container of claim 8, wherein the second closure member is biased into engagement with the container base.

12. The container of claim 1, further comprising an insert accommodated within the container base, the insert defining a plurality of storage receptacles.

13. The container of claim 12, wherein the insert is a resilient material.

14. A container comprising:

a container base including a back member and a base sidewall extending upwardly thereform;

a container lid hingedly-connected to the container base and movable relative thereto between a closed position and an open position, the container lid including a front member and a lid sidewall extending downwardly thereform; and a closure extending from the container lid and engaging the container base to maintain the container lid in the closed position;

wherein the closure includes hingedly-connected first and second closure members, the first closure member being located on the lid and the second closure member releasably engaging the container base; and wherein the second closure member traverses a 90 degree angle so as to extend across portions of both the base sidewall and the back member.

15. The container of claim 14, wherein a recessed area is defined in the container base to receive the second closure member.

16. The container of claim 15, wherein the recessed area extends across the portions of both the base sidewall and the back member.

17. The container of claim 14, further comprising an adhesive label arranged on the back member and covering a portion of the second closure member, such that the adhesive label must be broken in order to release the second closure member from the base.

18. A container comprising:

a container base formed as a single piece including a back member and a base sidewall extending upwardly therefrom, at least one hanger opening being defined in the base sidewall;

a container lid hingedly-connected to the container base and movable relative thereto between a closed position and an open position, the container lid being formed as another single piece including a front member and a sidewall extending downwardly therefrom and at least partially overlying the base sidewall in the closed position;

a closure extending from the container lid and engaging the container base to maintain the container lid in the closed position, the closure including hingedly-connected first and second closure members, the first closure member being formed integrally with the container lid and extending from a lower edge of the lid sidewall, the second closure member traversing a 90 degree angle so as to extend across portions of both the base sidewall and the back member;

a resilient insert accommodated in the container base and defining a plurality of storage receptacles; and a hanger having a heed portion defining a central opening and at least one leg received in the at least one hanger opening.

19. The container of claim 18, further comprising an adhesive label arranged on the back member and covering a portion of the second closure member, such that the adhesive label must be broken in order to release the second closure member from the base.

* * * * *